United States Patent [19]

Toshima

[11] Patent Number: 4,777,334

[45] Date of Patent: Oct. 11, 1988

[54] PORCELAIN CLAD, GAS, CIRCUIT INTERRUPTER OPERATION ROD STRUCTURE

[75] Inventor: Norichika Toshima, Amagasaki, Japan

[73] Assignee: Mitsubishi Denki Kabushiki Kaisha, Japan

[21] Appl. No.: 875,056

[22] Filed: Jun. 17, 1986

[30] Foreign Application Priority Data

Jun. 18, 1985 [JP] Japan ..... 60-130709

[51] Int. Cl.[4] ..... H01H 33/82

[52] U.S. Cl. ..... 200/148 R; 200/148 F

[58] Field of Search ..... 200/148 F, 148 R

[56] References Cited

U.S. PATENT DOCUMENTS

| | | | |
|---|---|---|---|
| 4,500,762 | 2/1985 | Yoshizumi | 200/148 R |
| 4,618,752 | 10/1986 | Ozaki et al. | 200/148 R |
| 4,652,708 | 3/1987 | Okuno et al. | 200/146 R |
| 4,687,890 | 8/1987 | Yamamoto et al. | 200/148 B |
| 4,688,136 | 8/1987 | Yamauchi | 361/120 |

*Primary Examiner*—Robert S. Macon

*Attorney, Agent, or Firm*—Leydig, Voit & Mayer

[57] ABSTRACT

A porcelain clad gas circuit interrupter is disclosed which includes: an arc extinguishing porcelain tube defining therein an arc extinguishing chamber in which a stationary and a movable contact are disposed, the arc extinguishing chamber being filled with an insulating gaseous medium; and a hollow support porcelain tube supporting the arc extinguish porcelain tube and communicating with the arc extinguishing chamber. An insulating operation rod having its opposite ends formed hollow is disposed in the support porcelain tube and adapted to operate the movable contact for closing and opening thereof against the stationary contact. A pair of shield members are received in the opposite hollow ends of the insulating operation rod and have their base end mounted on the opposite ends of the insulating operation rod and their distal end configured into a gradually curved shape such as a semi-spherical shape whereby the distribution of potential at the distal ends of the shield members can be improved to materially reduce the electric field strength along the surface of the support porcelain tube, thus enhancing the voltage-withstanding property thereof without increasing the size or diameter of the support porcelain tube. Preferably, each of the shield members is of a cylindrical configuration and has a positioning projection formed at its side surface for abutting engagement with the inner surface of the support porcelain tube.

10 Claims, 3 Drawing Sheets

FIG. 2A
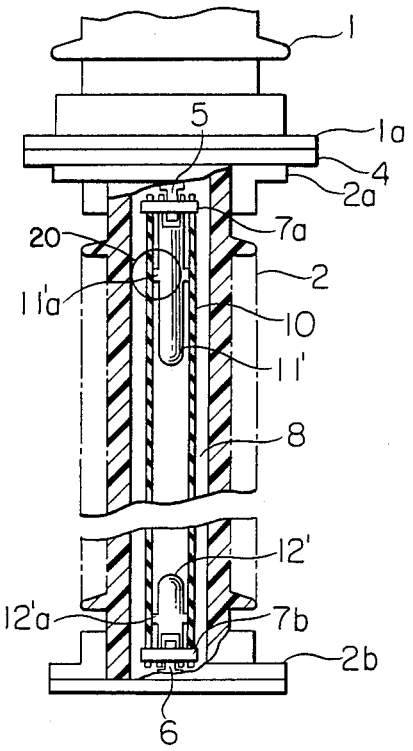
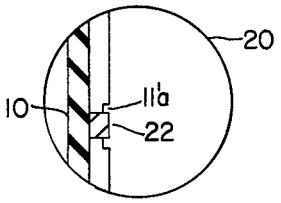
FIG. 2B

PORCELAIN CLAD, GAS, CIRCUIT INTERRUPTER OPERATION ROD STRUCTURE

BACKGROUND OF THE INVENTION

1. Field of the Invention

This invention relates generally to a porcelain clad, gas, circuit interrupter for a power line or circuit, and more particularly, to such a circuit interrupter of the type in which an insulating operation rod is disposed in a support porcelain tube supporting an arc extinguishing porcelain tube defining therein an arc extinguishing chamber in which a stationary and a movable contact are accommodated, the operation rod being adapted to open or close the movable contact against the stationary contact and provided at its opposite ends with a pair of shield members.

2. Description of the Prior Art

A conventional porcelain clad, gas, circuit interrupter is shown in FIG. 3. In this Figure, reference numeral 1 designates an arc extinguishing porcelain tube defining therein an arc extinguishing chamber (15) in which a movable contact 14 and a stationary contact (16) are accommodated. The arc extinguishing porcelain tube 1 is supported by a support porcelain tube 2 in which an insulating operation rod 3 is disposed for operating the movable contact (14) in the arc extinguishing chamber (15) for opening and closing it with the stationary contact (16) for interrupting a power circuit or line. The support porcelain tube 2 has an upper flange **2*a* and a lower flange 2*b* formed at the upper and lower ends thereof, the upper flange 2*a* being provided with a connector flange 4 adapted for connection with a connector flange 1*a* of the arc extinguishing porcelain tube 1. The insulating operation rod 3 is connected at its upper end adjacent the arc extinguishing porcelain tube 1 by means of, for example, a connector pin 7*a* with a socket end 5*a* of a rod 5 leading to the movable contact in the arc extinguishing porcelain tube, and at its lower end by such as a connector pin 7*b* with a socket end 6*a* of a rod 6 leading to a drive source. The socket end 5*a* of the rod 5 is formed of an electrically conductive material and serves as an upper shield for alleviating or diminishing the strength of electric field affected by the upper flange 2*a* and the connector flange 4 of the support porcelain tube 2. Similarly, the socket end 6*a* of the rod 6 is formed of an electrically conductive material and serves as a lower shield for alleviating or diminishing the electric field affected by the lower flange 2*b* of the support porcelain tube 2. The arc extinguishing porcelain tube 1 and the support porcelain tube 2 are filled with an electrically insulating gaseous medium 8 such as SF6 gas. Reference numeral 9** designates equipotential surfaces.

In such a conventional porcelain clad, gas, circuit interrupter, however, the upper and lower shield members **5*a*, 6*a* include pointed edges or sharp projections. Accordingly, when a voltage of a predetermined value is imposed across the stationary and movable contracts (14) in the arc extinguishing porcelain tube 1, the strength of electric field thus created is the highest at the distal end of the upper shield member 5*a*, which acts as an internal electrode. For this reason, it is desired that the distal end of the upper shield member 5*a* be configured into a round shape or into a gradually changing shape so as to reduce the electric field strength. On the other hand, the porcelain tubes 1 and 2 have to be reduced in size for the purposes of cutting down production costs, as a result of which it becomes difficult to maintain a certain minimum distance required for electrical insulation between the upper shield member 5*a* and the inner side surface of the support porcelain tube 2**.

The conventional porcelain clad, gas, circuit interrupter as constructed in the above-described manner has involved the following problems. Specifically, when a high voltage is imposed across the stationary and movble contacts (not shown) in the arc extinguishing porcelain tube 1, the density of the equipotential surfaces (or the electric flux density) becomes higher at that portion of the support porcelain tube 2 near the distal end of the upper shield member 5a so that the electric field strength along the surface of that portion of the support porcelain tube 2 is extremely large. Consequently, the support porcelain tube 2 must have an extremely high resistance to voltage and to this end, it is necessary to increase the diameter of the support porcelain tube 2, thus resulting in an increase in overall size and production costs.

SUMMARY OF THE INVENTION

In view of the above, the present invention is intended to obviate the above-described problems of the prior art, and has for its object the provision of a porcelain clad gas circuit interrupter of the type described above in which field strength along the surface of the support porcelain tube can be materially reduced to enhance the voltage-withstanding property thereof by improving the distribution of potential therearound without increasing the size or diameter of the support porcelain tube.

In order to achieve the above object, according to the present invention, there is provided a porcelain clad, gas, circuit interrupter which comprises: an arc extinguishing porcelain tube defining therein an arc extinguishing chamber in which a stationary and a movable contact are disposed, the arc extinguishing chamber being filled with an insulating gaseous medium; a hollow support porcelain tube supporting the arc extinguish porcelain tube and communicating with the arc extinguish chamber; an insulating operation rod disposed in the support porcelain tube and connected at its one end to said movable contact and at its other end to a drive source, said rod being adapted to operate the movable contact for closing and opening thereof against the stationary contact, the insulating operation rod having its opposite ends formed hollow; and a pair of shield members adapted to be received in the opposite hollow ends of the insulating operation rod, the shield members having their base end mounted on the opposite ends of the insulating operation rod and their distal end configured into a gradually curved shape.

According to the present invention there is also provided an operating rod structure comprising an insulating tube, an insulating operation rod disposed in said insulating tube and having a first hollow end and a second hollow end, a first shield member having a distal end configured into a gradually curved shaped and formed to engage said first hollow end, and a second shield member having a gradually curved distal end and formed to engage said second hollow end.

Preferably, the distal end of each of the shield members is configured into a semi-sphericial shape.

Preferably, the insulating operation rod comprises a hollow cylinder formed of an electrically insulating material.

In a preferred embodiment, each of the shield members is of a cylindrical configuration and has a positioning projection formed at its side surface for abutting engagement with the inner surface of the support porcelain tube.

It is preferred that the positioning projections of the shield members be each provided with an electrical insulator.

The above and other objects, features and advantages of the present invention will become apparent from the following detailed description of a few presently preferred embodiments of the invention when taken in conjunction with the accompanying drawings.

BRIEF DESCRIPTION OF THE DRAWINGS

FIG. 2A is a partially cross sectional view similar to FIG. 1, showing another embodiment of the present invention;

FIG. 2B is a modification of a portion of the FIG. 2A structure; and

DESCRIPTION OF THE PREFERRED EMBODIMENTS

Figure 1:
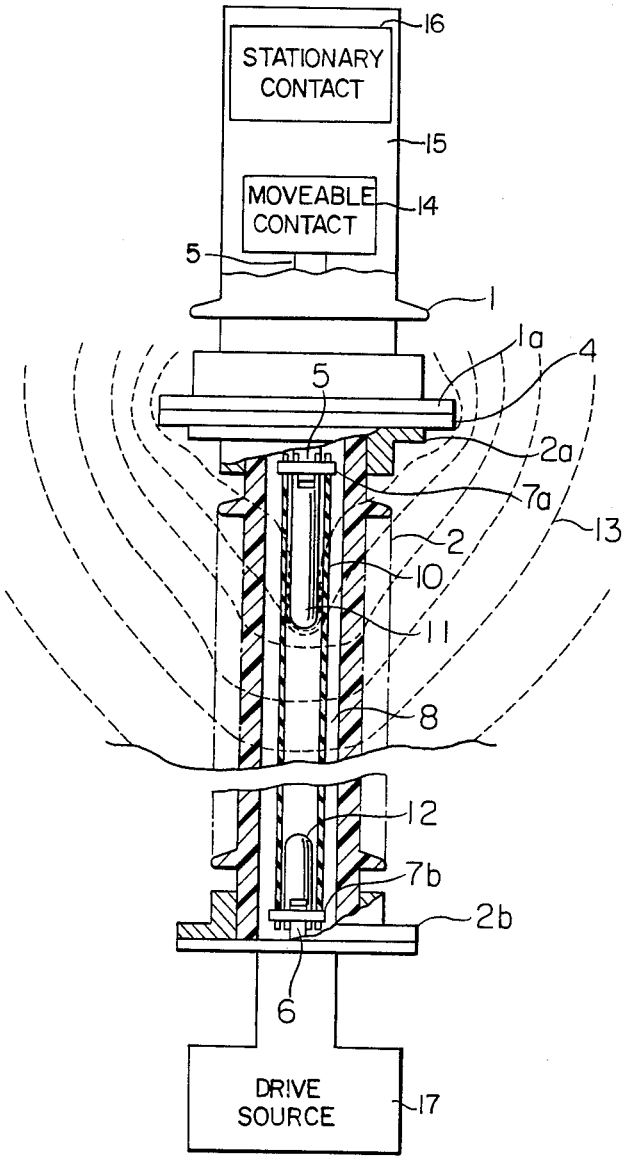
FIG. 1 is a partially cross sectional side view showing essential parts of a porcelain clad, gas, circuit interrupter in accordance with one emodiment of the present invention.

In FIG. 1, there is shown one embodiment of a porcelain clad gas circuit interrupter constructed in accordance with the principles of the present invention. In this Figure, the components designated by reference numerals 1, 1*a*, 2, 2*a*, 2*b*, 4, 5, 6, 7*a*, 7*b* and 8 are the same as those shown in FIG. 3.

According to the present invention, an insulating operation rod 10 is formed of a hollow cylinder of an electrically insulating material, and connected at its upper end by means of such as a connector pin 7*a* with a rod 5 leading to a movable contact 14 in an arc extinguishing porcelain tube 1, and at its lower end by such as a connector pin 7*b* with a rod 6 leading to a drive source 17. Accommodated in the cylindrical operation rod 10 at its upper and lower ends are an upper shield member 11 formed of an electrically conductive material for alleviating the electric field affected by an upper flange 2*a* and a connector flange 4 of a support porcelain tube 2, and a lower sheld member 12 formed of an electrically conductive material for alleviating the electric field affected by a lower flange 2*b* of the support porcelain tube 2. The upper and lower shield members 11, 12 are respectively mounted, together with the opposite ends of the operation rod 10 by the connector pins 7*a* and 7*b*, on the rods 5 and 6. Each of the upper and lower shield members 11, 12 is in the form of a cylindrical configuration with their distal end being configured into a gradually curved shape such as a semi-spherical shape. Thus, no sharp edges or pointed projections are formed at the distal ends of the upper and lower shield members 11 and 12.

Figure 3:
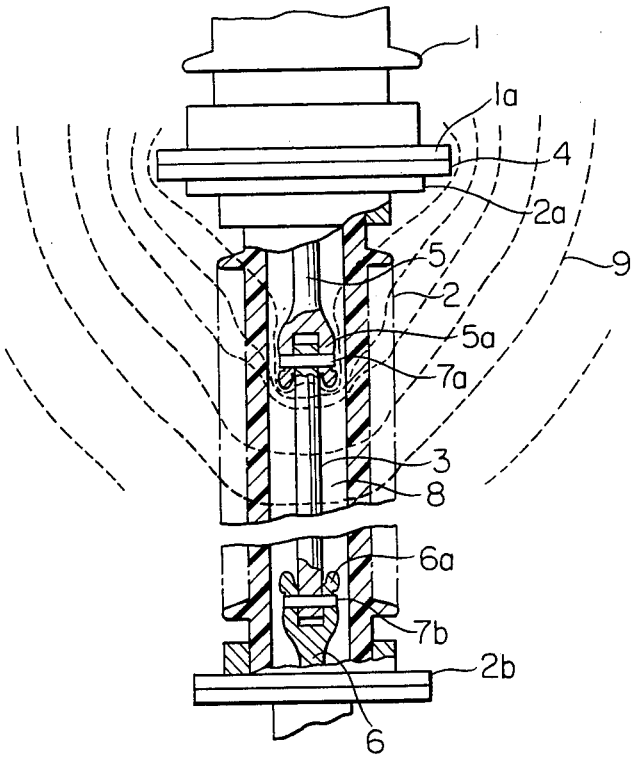
FIG. 3 PRIOR ART
FIG. 3 is a partially cross sectional view showing essential parts of a conventional porcelain clad gas circuit interrupter.

In the porcelain clad gas circuit interrupter as constructed in the above-described manner, it is possible to provide sufficient clearances for electrical insulation between the upper and lower shield members 11, 12 in the cylindrical insulating operation rod 10 and the inner surface of the cylindrical support porcelain tube 2 so that upon application of a voltage of a predetermined value across the stationary and movable contacts 14 in the arc extinguishing porcelain tube 1, the resultant potential distribution can be improved. In fact, as clearly illustrated by the broken lines in FIG. 1, the density of the equipotential surfaces 13 (or the electric flux density) can be made much lower at the distal end of the upper shield member 11 than that in the conventional circuit interrupter as shown in FIG. 3, and at the same time, it is possible to decrease the field strength along the inner surface of the support porcelain tube 2 near the distal end of the upper shield member 11.

FIG. 2A shows another embodiment of the present invention. In this embodiment, the upper and lower shield members 11', 12' are modified such that they are each provided on their side surface with an annular positioning projection 11'*a* or 12'*a* which is adapted to abuttingly engage the inner surface of the cylindrical insulating operation rod 10 for securely holding the upper or lower shield member 11' or 12' in position without any sidewise displacement. As a result, it is ensured that predetermined constant clearances are always formed between the side surfaces of the upper and lower shield members 11', 12' and the inner surface of the cylindrical insulating operation rod 10. The positioning projections 11'*a*, 12'*a* are located sufficiently remote from the distal ends of the upper and lower shield members 11, 12 so that they do not affect the electric field therearound.

In this connection, it is to be noted that in general, when there is a limited gap or clearance between electrodes and an electrical insulator disposed therearound during application of a voltage across the electrodes, the electric field strength on the surfaces of the electrodes increases from the ordinary level by an amount multiplied by the dielectric constant of the insulator. In this embodiment, although the field strength at the distal end of the upper shield member 11' inside the support porcelain tube 2 is considerably higher than the remaining portion therein, there will be substantially no possibility of such a limited gap forming so that reliability in the voltage withstanding property of the support porcelain tube 2 can be materially improved.

In addition, the positioning projections 11'*a*, 12'*a* may be provided, with an electrical insulator 22 as shown in FIG. 2B for alleviating any abnormally high field at the positioning projections 11'*a*, 12'*a* which would be created upon application of a high voltage.

Although in the illustrated embodiments, the insulating operation rod 10 comprises a hollow cylinder, it may be of a solid cylinder having its opposite ends formed hollow into which the upper and lower shield members 11, 12 are received.

What is claimed is:

1. A porcelain clad, gas, circuit interrupter comprising:

an arc extinguishing porcelain tube defining therein an arc extinguishing chamber in which a stationary and a movable contact are disposed, said arc extinguishing chamber being filled with an insulating gaseous medium;

a hollow support porcelain tube supporting said arc extinguishing porcelain tube and communicating with said arc extinguishing chamber;

an insulating operation rod disposed in said support porcelain tube and connected at its one end to said movable contact and at its other end to a drive source, said rod being adapted to operate said movable contact for closing and opening thereof against said stationary contact, said insulating operation rod having its opposite ends formed hollow; and a pair of shield members adapted to be received in the opposite hollow ends of said insulating operation rod, said shield members having their base end mounted on the opposite ends of said insulating operation rod and their distal end configured into a gradually curved shape.

2. A porcelain clad, gas, circuit interrupter as claimed in claim 1 wherein the distal end of each of said shield members is configured into a semi-spherical shape.

3. A porcelain clad, gas, circuit interrupter as claimed in claim 1 wherein said insulating operation rod comprises a hollow cylinder formed of an electrically insulating material.

4. A porcelain clad, gas, circuit interrupter as claimed in claim 1 wherein each of said shield members is of a cylindrical configuration and has a positioning projection formed at its side surface for abutting engagement with the inner surface of said support porcelain tube.

5. A porcelain clad, gas, circuit interrupter as claimed in claim 4 wherein said positioning projections of said shield members are each provided with an electrical insulator.

6. An operating rod structure comprising:

an insulating tube;

an insulating operation rod disposed in said insulating tube and having a first hollow end and a second hollow end;

a first shield member having a distal end configured into a gradually curved shape and formed to engage said first hollow end; and a second shield member having a gradually curved distal end and formed to engage said second hollow end.

7. An operating rod structure as claimed in claim 6 wherein the distal end of each of said shield members is configured into a semi-spherical shape.

8. An operating rod structure as claimed in claim 6 wherein said insulating operation rod comprises a hollow cylinder formed of an electrically insulating material.

9. An operating rod structure as claimed in claim 6 wherein each of said shield members is of a cylindrical configuration and has a positioning projection formed at its side surface for abutting engagement with the inner surface of said support porcelain tube.

10. An operating rod structure as claimed in claim 9 wherein said positioning projections of said shield members are each provided with an electrical insulator.

* * * * *